United States Patent [19]

Juergens

[11] 4,195,510

[45] Apr. 1, 1980

[54] DRAW BEAD HAVING ALTERNATING PRESSURE SURFACES AND GROOVES

[76] Inventor: William A. Juergens, 37126 Yorkshire, Apt. 139, Sterling Heights, Mich. 48077

[21] Appl. No.: 919,210

[22] Filed: Jun. 26, 1978

[51] Int. Cl.[2] ..... B21D 22/00

[52] U.S. Cl. ..... 72/350; 72/377; 72/379

[58] Field of Search ..... 72/347, 348, 350, 379, 72/377

[56] References Cited

U.S. PATENT DOCUMENTS

| | | | |
|---|---|---|---|
| 2,330,228 | 9/1943 | Lyon | 72/348 X |
| 2,356,457 | 8/1944 | Sonda | 72/348 X |
| 3,000,274 | 9/1961 | Duskey et al. | 72/348 X |
| 3,957,005 | 5/1976 | Heffner | 72/348 |
| 4,051,707 | 10/1977 | Valel et al. | 72/348 |

*Primary Examiner*—Leon Gilden

*Attorney, Agent, or Firm*—Cullen, Sloman, Cantor, Grauer, Scott & Rutherford

[57] ABSTRACT

A draw bead made integral with the die plate or as an insert and having alternating pressure applying surfaces and grooves which will thicken the metals drawn across it minutely at the grooves and will distribute the metal evenly at the pressure surfaces. The draw bead is preferably placed close to the draw radius of the die cavity, and it can have various shapes to compliment the shape of the die cavity. Substantially less blank holder pressure is required because the draw bead restrains the flow of metal and better distributes the metal as it is drawn into the die cavity, and since the draw bead is close to the draw radius, a smaller blank holder is possible. The draw bead can be used to form a portion of the drawn part thereby eliminating a secondary forming operation if the part requires a flat flange about its trim line. When spotting in a new die, metal thickening in certain areas can be greatly reduced or prevented by applying pressure to the underside of the draw bead by hydraulic, pneumatic, or other resilient elements which can be made individually adjustable.

7 Claims, 10 Drawing Figures

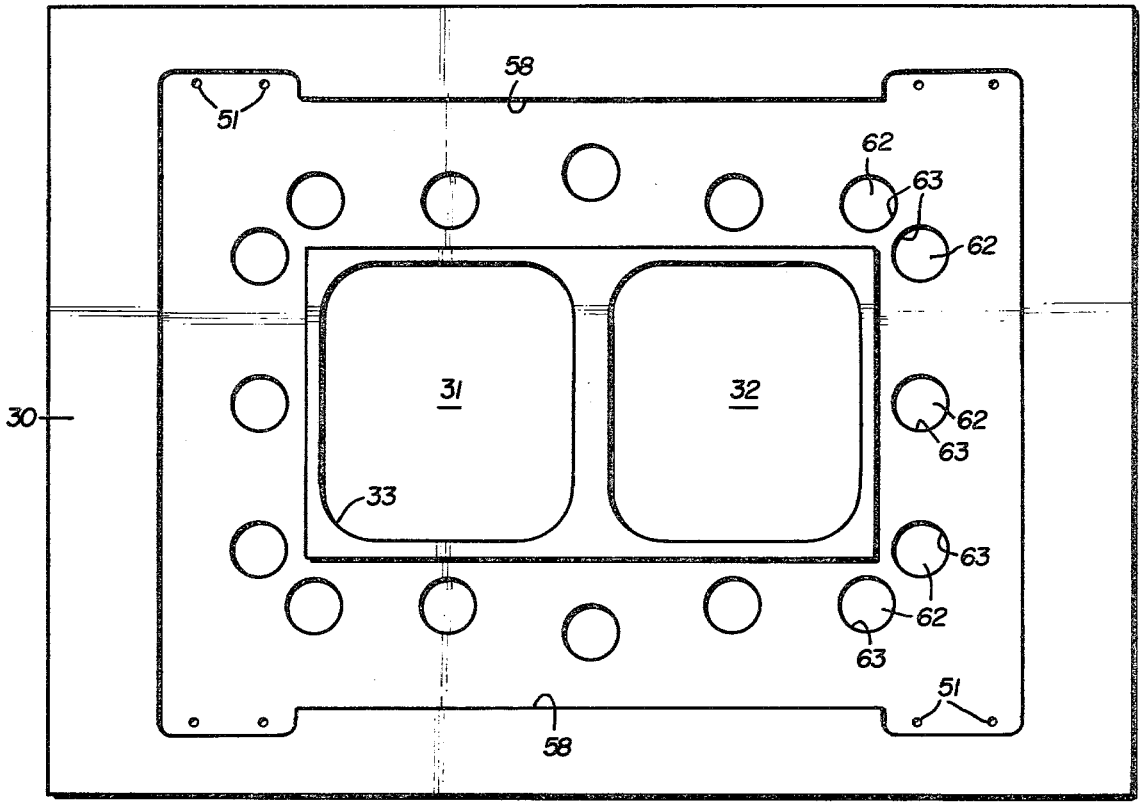
FIG. 3
FIG. 2
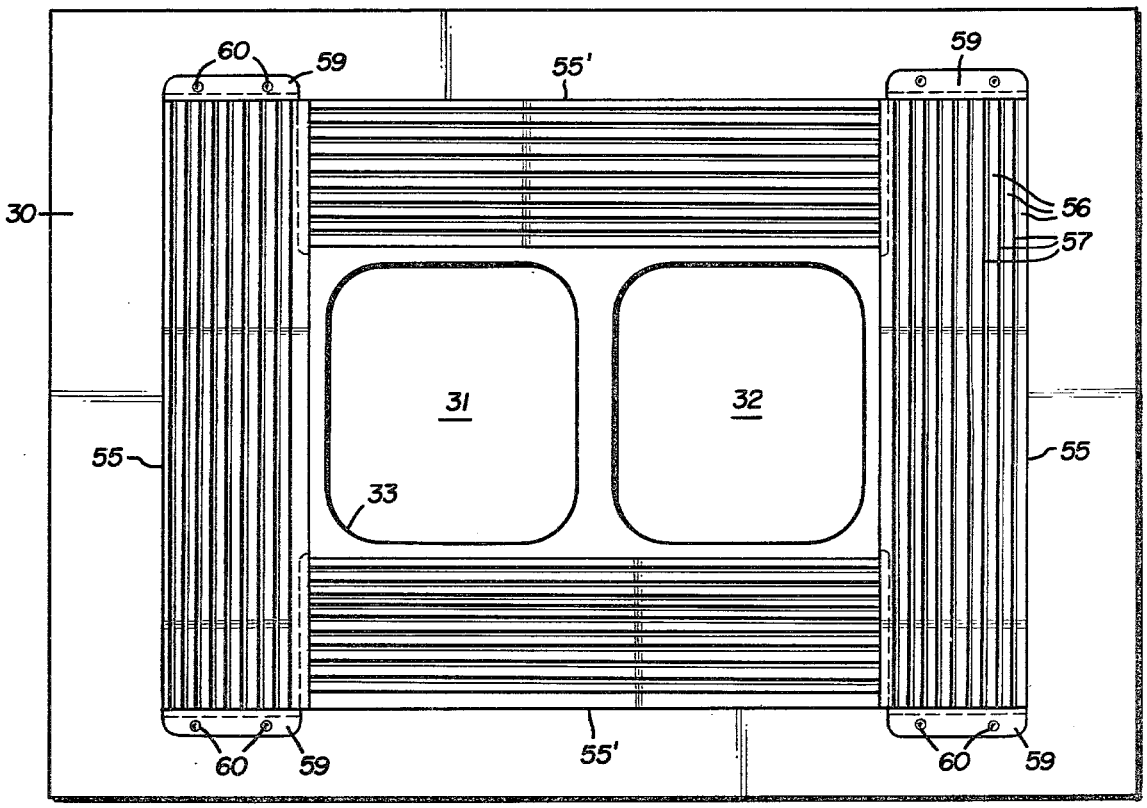

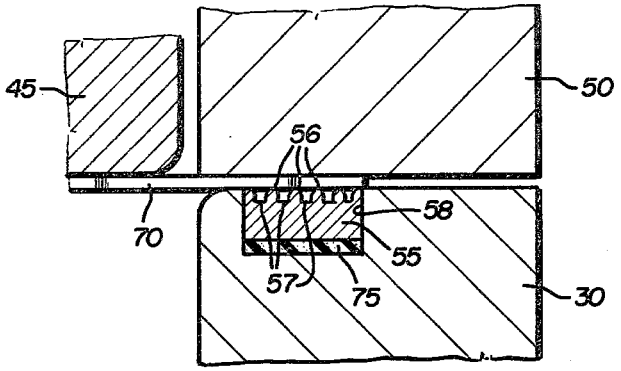
FIG. 4
FIG. 5
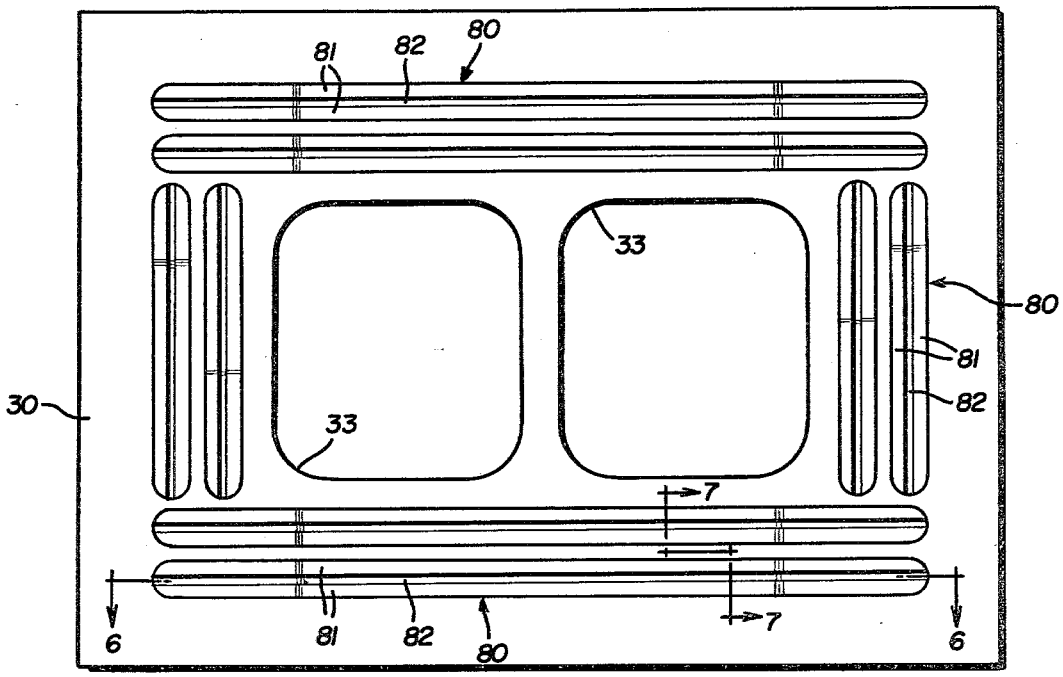
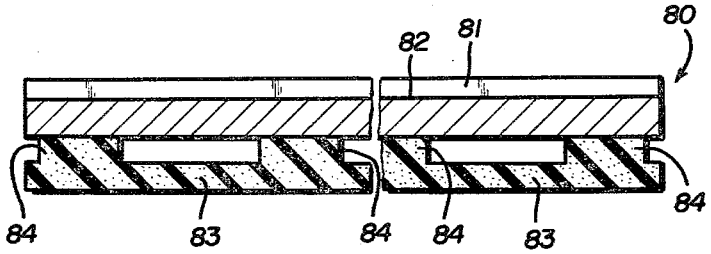
FIG. 6
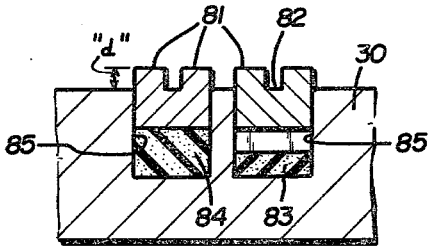
FIG. 7

DRAW BEAD HAVING ALTERNATING PRESSURE SURFACES AND GROOVES

BACKGROUND OF THE INVENTION

This invention relates to a draw bead having alternating pressure-applying surfaces and grooves which force metal drawn across it to thicken minutely at the grooves and distribute evenly at the pressure surfaces thereby restraining the flow of metal and preventing the metal from wrinkling.

Drawing of sheet metal parts consists of pulling a sheet metal blank over a draw ring radius into a die cavity and forming a recessed part by forcing the plastic flow of metal into the die cavity. Drawing operations offer modern industry an opportunity to produce complex parts, such as stainless steel kitchen sinks, without resorting to other more complicated and costly metal working techniques. Cylindrical or cupped-shaped shells are produced by a moving punch that draws the metal into a stationary die cavity having the required contour. The punch and die action moves the whole mass of the metal blank at once thereby creating severe tensile stresses in the workpiece just above the punch nose as the remainder of the blank resists being drawn into the cavity.

A holding pressure is required in most metal drawing and some redrawing to prevent the formation of bulges and wrinkles in the metal not yet drawn into the die. The severe tensile stresses created by the punch are balanced by radial compressive stresses in the metal not yet drawn into the die, resulting in bulges and wrinkles in its outer portions where the compressive yield strength is exceeded. When wrinkling or bulging occurs, the metal thickens as it is gathered into the cavity of a die, and it is sometimes necessary to use draw beads on the blank-holding surfaces to grip the edges of the workpiece sufficiently so that the formation of wrinkles and bulges is reduced.

The purpose of a conventional draw bead is to restrain the flow of metal where needed, to stretch the metal, and to keep the metal from wrinkling. Conventional draw beads are placed outside the trim line of the part, and they are rib-like projections on the hold-down surfaces for controlling metal flow.

When a die for a difficult part is put into tryout, many parts are scrapped because of metal wrinkling. While draw beads placed outside the trim line and increased blank holder pressure has helped to prevent the metal from wrinkling, a great amount of skill has been required to spot-in a new die for a difficult part.

It is accordingly the general objective of the present invention to provide a draw bead to restrain the flow of metal where needed, to stretch the metal, and keep it from wrinkling.

SUMMARY OF THE INVENTION

The draw bead apparatus of the present invention has alternating pressure-applying surfaces and grooves which will thicken the metal drawn across it minutely at the grooves and will distribute the metal evenly at the pressure surfaces. The draw bead is most effective when it is placed close to the draw radius of the die cavity to restrain the flow of metal and better distribute the metal as it is drawn into the die cavity. It holds and prevents the metal from wrinkling at substantially less blank holder pressure than was heretofore possible, and it can, therefore, be used on smaller blanks where there are no conventional draw beads outside the trim line.

The draw bead disclosed herein can be used to form a portion of the drawn part if the part has a flat flange lying along an axis substantially perpendicular to the cupped portion drawn into the die cavity. An example of a part that has a flat flange around the draw radius is a stainless steel kitchen sink. The draw bead, assembled in the die plate close to the draw radius, helps to distribute the metal and form the flat flange required for the kitchen sink. The blank holder can be reduced in size from those taught by the prior art because of the draw bead placement close to the draw radius. Additionally, since the draw bead forms the required flange, a secondary forming operation is eliminated.

The present draw bead may be an integral part of the die holder or inserted into a machined groove around the draw radius. An insert is preferred because it affords the use of selected wear-resistent steel that can be substituted depending on the metal drawn. Additionally, selected pressure points can be applied to the underside of an inserted draw bead that aid the draw bead in restraining metal flow in certain selected areas around the die cavity.

When spotting in a new die, metal thickening in certain areas can be prevented by applying pressure to the underside of the draw bead insert at the proper areas. The pressure is selectively applied by resilient elements, such as rubber gaskets, where the rubber gasket is placed into the machined die groove and the draw bead set into the groove on top of the gasket. Pressure points may also be built into the die that are hydraulically, pneumatically or spring controlled, and each pressure point can be made individually adjustable.

The preferred embodiment includes a draw bead inserted into a machined groove around the draw radius wherein, before drawing commences, the pressure applying surfaces of the draw bead lie in a horizontal plane slightly above the horizontal plane of the die plate's upper surface. The blank holder is forced downwardly under pressure to engage and hold the metal blank against the draw bead, and simultaneously, the draw bead is depressed into its machined groove compressing the rubber, hydraulic, pneumatic or spring pressure point beneath it so that during the drawing step the draw bead pressure surfaces lie in the same horizontal plane as the upper horizontal surface of the die plate.

Some of the advantages from the draw bead of the present invention are as follows: the draw bead permits true drawing action because the alternating pressure surfaces and grooves permit the metal drawn across it to thicken minutely at the grooves and distribute evenly at the pressure surfaces; the improved draw bead may be an integral part of the draw ring or inserted into a machined groove in the die; a smaller blank holder is possible because the draw bead is preferrably placed close to the draw radius; the draw bead keeps the metal from wrinkling at less blank holder pressure which decreases the need for die-spotting to overcome metal thickening at certain areas for newly designed parts; the draw bead can be used to form a required flange which eliminates a secondary forming operation; and controllable pressure points can be conveniently located under the draw bead to correct problem areas of metal thickening.

Other advantages and meritorious features of this invention will be more fully appreciated from the following detailed description and the appended claims.

DESCRIPTION OF THE DRAWINGS

FIG. 2 is a top plan view of the die plate of FIG. 1 with draw beads assembled therein;

FIG. 3 is a top plan view of the die plate of FIGS. 1 and 2 with the draw beads removed from the die plate;

FIG. 4 is an exploded side view of the draw bead assembly prior to drawing;

FIG. 5 is a top plan view of the die plate in FIG. 1 having a second embodiment of the draw bead assembled therein;

FIG. 6 is a cross-sectional view taken along line 6—6 in FIG. 5 showing the draw bead supported by a resilient pad;

FIG. 7 is a cross-sectional view taken along line 7—7 in FIG. 5;

DETAILED DESCRIPTION OF THE INVENTION

Figure 1:
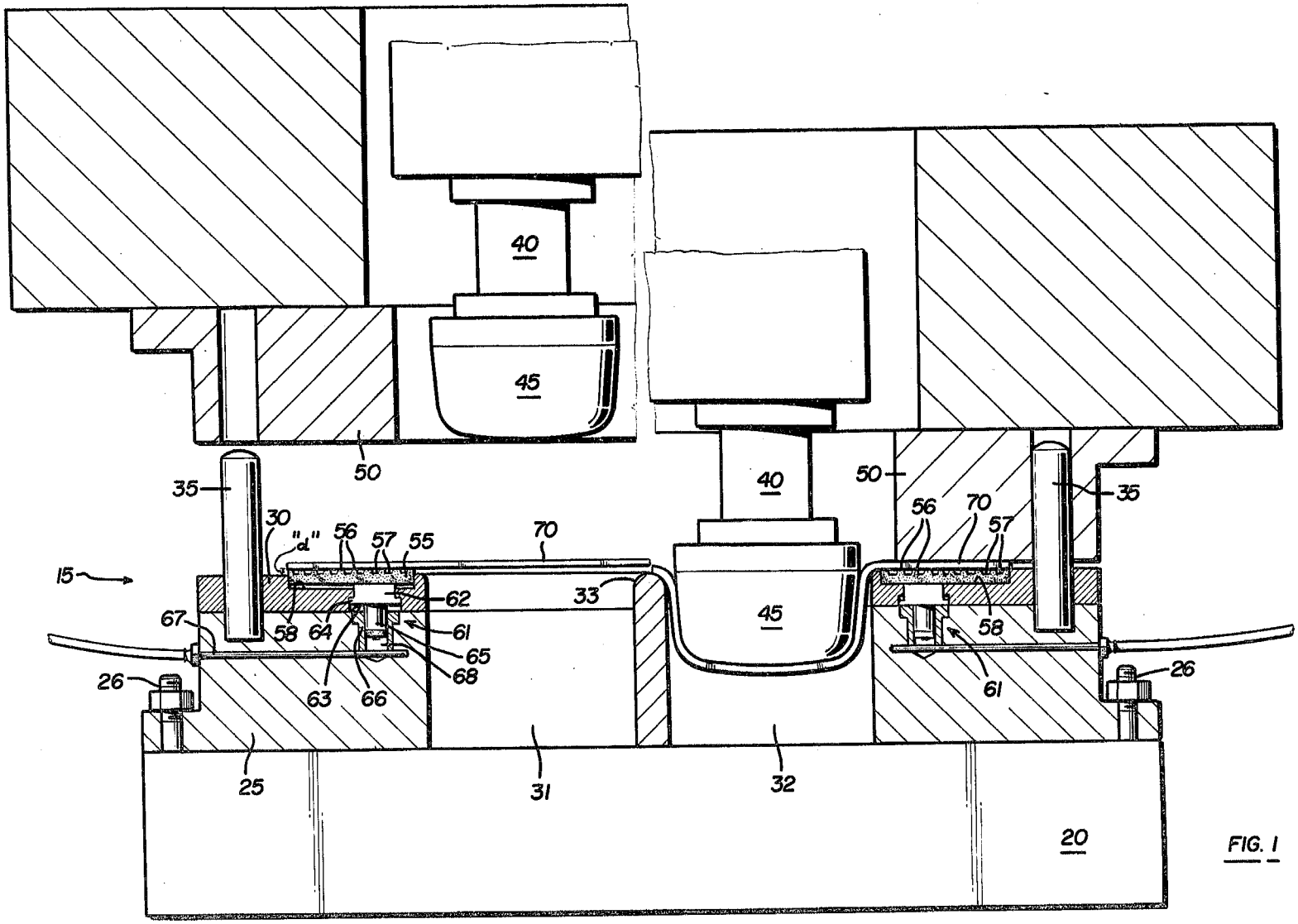
FIG. 1 is a partial cross-sectional schematic view of the overall die-set assembly showing one embodiment of the draw bead construction in the present invention supported by selectively adjustable pressure assemblies.

The teachings of the present invention, as discussed herein, are generally applicable to the cold working of metals and, more specifically, to metal drawing including deep drawing, using various dies, die shapes, and die configurations. Referring more particularly to the drawings, FIG. 1 illustrates an overall die set apparatus 15 including a press bed 20, a die shoe 25 secured to the press bed by hold-down bolts 26, a die plate 30 having two cavity openings 31 and 32, guide pins 35, a punch holder 40, a punch 45 and a blank holder 50.

FIG. 1 is a schematic cross-section of the die-set assembly 15 but more particularly the die plate 30 and draw bead combination 55,55' which is further shown in FIGS. 2 and 3 and is used for drawing stainless steel kitchen sinks. FIGS. 1–3 illustrate only one embodiment of the present draw bead wherein die plate 30 is fitted with plural substantially identical draw beads 55 and 55'. Various other die plate configurations having other die bead constructions also taught herein are within the scope of the present invention.

The draw beads 55 and 55' have a plurality of pressure-applying surfaces 56 alternating with grooves 57 as shown in FIGS. 1 and 2. These alternating pressure-applying surfaces 56 and grooves 57 form the basis for the invention and provide an important feature in that they force metal drawn across them to thicken minutely at the grooves and distribute evenly at the pressure surfaces thereby restraining the flow of metal and preventing the metal from wrinkling. Draw beads 55 and 55' function in the same manner, and the minor structural distinctions, such as length and tab portions 59 on draw beads 55, are for the purpose of accommodating various die shapes and assembly requirements.

In the particular embodiment shown in FIGS. 1–3, the draw beads 55 and 55' have an elongated rectangular shape, and they are inserted into a machined groove 58 (FIG. 3) in the die plate 30. The true drawing action provided by the draw beads is most effectively utilized if they are placed close to the draw radius 33 for the die cavities 31 and 32 which differs from prior draw bead constructions where the draw bead is mounted on the blank holder outside the trim line of the part. Placing the draw beads close to the draw radius provides the advantages of reduced metal thickening, a smaller blank holder, and the elimination of a flange-forming step.

FIG. 2 is a top plan view of the draw beads 55 and 55' assembledin the die plate 30, and FIG. 3 is the same view with the draw beads removed. FIG. 1 illustrates draw beads 55 in cross-section, and it is equally illustrative of draw bead 55' in cross-section.

A conventional draw bead is a rib-like projection, and it is mounted on the blank holder 50 outside the trim line of the part drawn, thereby requiring a wider blank holder 50 than illustrated in FIG. 1. The present invention permits the use of a smaller blank holder 50 because the draw beads are preferably placed adjacent the draw radius of the die cavities as shown in FIGS. 1–3. Additionally, less blank holder pressure is required when using one of the draw bead constructions taught by the disclosure than would be required using a conventional draw bead.

The draw bead embodiment shown in FIGS. 2 and 3 includes draw beads 55 having cut-out or lapped end portions (shown in phantom in FIG. 2) that overlap and mate with complimentary relieved portions of the draw beads 55'. Draw beads 55 include tab portions 59 fixed to their ends, and the entire draw bead assembly 55 and 55' is held in the machined groove 58 by fasteners 60 which pass through holes in tabs 59 and are secured to die plate 30 by threaded openings 51 (FIG. 3).

A series of individually adjustable pressure point assemblies 61 are built into the die plate 30 for selective application of additional holding pressure to the underside of the draw beads at certain areas that are susceptible to metal thickening or wrinkling. Each pressure point assembly 61 includes a cylindrical pressure pad 62 (FIG. 1) slidable in an opening 63 of die plate 30 and engageable with the underside of a draw bead. The pressure pad 62 is limited in its upward movement against a draw bead by an enlarged end portion 64 that limits the extent of linear travel by the pressure pad 62 in the openinng 63.

As best illustrated in FIG. 1, the pressure pad 62 sits loosely on a reciprocating piston 65 which is slidably mounted in a sleeve bearing 66. The sleeve bearing 66 is pressure-fitted into the shoe 25, and it forms a cylindrical seal in which the piston is linearly movable. A pressurized line 67 is connected to a well 68 beneath the piston 65, and hydraulic or pneumatic fluid is forced into the well elevating the piston and the draw bead.

The operation of the die set assembly will be described by reference to FIG. 1 where the left portion of the figure illustrates the position that all the elements assume prior to a drawing operation and the right portion of the figure illustrates the position that all the elements assume during a drawing operation. Thus, FIG. 1 is a split view showing the elements before and during drawing. The die plate 30 is removable from its die shoe 25, and it can be interchanged with other die plates for drawing different parts. The general operation and construction of the overall die set assembly 15 is conventional and forms no part of the present invention.

A flat metal blank 70 is placed on top of the die plate 30 prior to drawing as illustrated in the lefthand portion of FIG. 1 and both plungers 45 and the blank holder 50 are elevated above the metal blank in an inoperative position. One of the features of the invention is that the horizontal plane of the draw bead pressure-applying surfaces 56 is elevated above the horizontal plane of the die plate's top surface prior to drawing by a distance "d" as illustrated in FIG. 1. A preset pressure in line 67 against the underside of piston 65 elevates the draw bead slightly above the bottom of the machined groove 58 approximately 1/16 of an inch (FIG. 1).

The first step in the drawing operation, after metal blank 70 is positioned on the die plate, moves the blank holder 50 under pressure along guide pins 35 against the metal blank 70 to sandwich the metal blank between the blank holder 50 and draw bead. Simultaneously, the draw bead is depressed into the die plate by the distance "d" such that its pressure engaging surfaces 56 horizontally align with the top horizontal plane of the die plate 30. The amount of pressure applied to the underside of the draw beads by the pressure point assemblies 61 is controlled by the preset pressure in pressurized lines 67, and thus, the pressure points 61 are used to increase or decrease metal thickening at their locations by varying the preset pressure in pressurized lines 67.

After blank holder 50 moves under pressure against the metal blank 70, which is fixed in place between the blank holder and die plate 30, both punches 45 move simultaneously downwardly to draw the metal into die cavities 31 and 32 as illustrated in the right portion of FIG. 1. There are severe tensile stresses created in the metal at the nose portions of the punches 45 during drawing which would normally result in metal thickening or wrinkles forming in the metal not yet drawn into the die cavities. Draw beads 55 and 55' permit the metal gripped between them and the blank holder 50 to stretch slightly which distributes the metal as it is drawn into the die cavities and additionally aids in the formation of a flange for the stainless steel sink around the draw radius thereby eliminating a secondary flange forming operation.

FIG. 4 illustrates the metal blank 70 gripped between the blank holder 50 and draw bead 55 prior to the drawing action by punch 45. The draw bead taught by the present invention includes alternating presure-applying surfaces 56 and grooves 57 wherein the grooves are approximately 1/16" wide. Depending on the size of the die plate and the type of part being drawn, other groove widths may be utilized. The draw bead 55 of FIG. 4 fits into machined groove 58 of the die plate 30, or alternatively, the draw bead can be made integral with the die plate. The pressure-applying surfaces 56 of the draw bead illustrated in FIG. 4 are arcuately shaped for concentrated pressure application, however, it may be desired to more evenly distribute the pressure against the metal blank 70 by using flat pressure-applying surfaces illustrated in FIGS. 7 and 10.

Draw bead 55 is supported by a resilient pad 75 shown in its compressed state in FIG. 4 under pressure from blank holder 50. As previously explained, the pressure-applying surfaces 56 lie in a horizontal plane that is approximately 1/16" above the top surface of the die plate 30 when there is no blank holder pressure being applied as illustrated in FIGS. 1, 7 and 10.

FIGS. 5–7 illustrate the most basic form of a draw bead constructed in accordance with the teachings of the present invention having two pressure-applying surfaces 81 separated by a single groove 82. A plurality of the bar-like draw beads 80 are fitted into machined grooves 81 in pairs adjacent the draw radius 33 of each die cavity in the die plate 30. Each draw bead is supported by resilient pressure pads 83 having selected box-like pressure points 84. The draw bead 80 and pressure pad 82 illustrated in FIGS. 5–7 constitute a simplified version of draw bead 55 and pressure point assembly 61 illustrated in FIGS. 1–3, although they function in the same manner.

Figure 8:
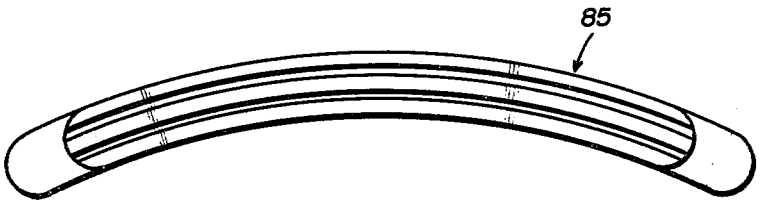
FIG. 8 is a top view of an arcuate draw bead made in accordance with the teachings of the present invention.
Figure 9:
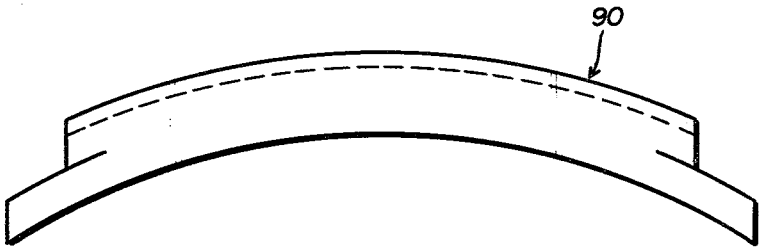
FIG. 9 is a side view of a convex draw bead made in accordance with the teachings of the present invention.

Other shapes and configurations for the draw bead are within the scope of the present invention as illustrated in FIGS. 8 and 9. FIG. 8 shows an arcuate draw bead 85 insertable into a machined groove adjacent the periphery of an arcuate die cavity, and FIG. 9 illustrates a convex draw bead 90. The shape of the draw bead is intended to compliment the die cavity shape or remedy problem areas of metal thickening, and the draw bead shapes disclosed in the drawings are only illustrative of draw bead shapes within the scope of the invention.

Figure 10:
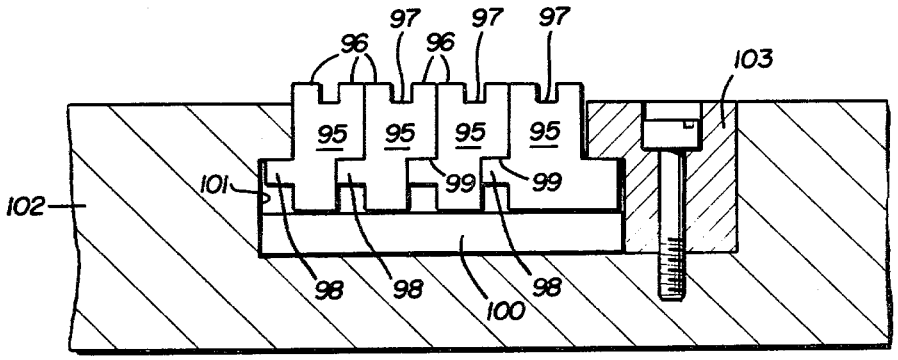
FIG. 10 shows still another embodiment of the draw bead assembly wherein a plurality of draw beads are nested in a machined groove of the die plate.

FIG. 10 illustrates a plurality of nested draw beads 95 wherein each draw bead has the two minimum pressure-applying surfaces 96 separated by a groove 97. Each draw bead has a horizontally projecting leg 98 that matingly engages a cut-out portion 99 of an adjacent draw bead. The whole assembly of draw beads is supported by a resilient pressure pad 100 in a machined groove 101 of die plate 102. A hold-down clamp 103 bears against one of the draw beads to hold the draw bead assembly in groove 101. The embodiment of FIG. 10 permits an increase or decrease in the width of the draw bead assembly because individual draw beads can be added or removed as desired depending on the part drawn.

It will be apparent to those skilled in the art that the foregoing disclosure is exemplary in nature rather than limiting, the invention being limited only by the appended claims.

I claim:

1. In a die plate having a die cavity wherein a metal blank is pulled over a draw ring radius into said die cavity for forming a recessed part by forcing the plastic flow of metal into the die cavity, said die plate having at least two pressure-applying surfaces adjacent to and substantially surrounding said die cavity, said pressure-applying surfaces being closely spaced and separated only by a groove;

said pressure-applying surfaces and groove forming the top surface of a draw bead insert, said die plate having a complementary groove which holds said draw bead insert;

said draw bead insert being supported by resilient means mounted in said die plate complementary groove; and said draw bead insert pressure-applying surfaces lying on a horizontal plane vertically spaced from the horizontal plane of the remaining portions of said die plate.

2. The die plate as defined in claim 1 wherein said draw bead has a box-like cross-section and a longitudinal axis extending in a straight line.

3. The die plate as defined in claim 1 wherein said draw bead is box-like in cross-section and arcuate along its longitudinal axis.

4. The die plate as defined in claim 1 wherein said resilient means includes a base portion and selected pressure portions mounted on said base portion, said pressure portions being spaced from each other in said die plate groove, said draw bead supported by said pressure portions.

5. The die plate as defined in claim 1 wherein said draw bead is supported by individually actuable pressure point assemblies mounted in said die plate groove.

6. The die plate as defined in claim 5 wherein said pressure point assemblies individually include a fluid actuated pressure pad for supporting said draw bead such that said draw bead pressure-applying surfaces lie in a horizontal plane vertically spaced above the remaining portions of said die plate.

7. A method of drawing metal by pulling a metal blank over a draw ring radius into a die cavity and forming a recessed part by forcing the plastic flow of metal into the die cavity comprising the steps of:

(a) supporting a metal blank on one of its surfaces by a die plate member having at least two pressure-applying surfaces separated only by a groove, said pressure-applying surfaces substantially surrounding said die cavity, said pressure-applying surfaces and groove forming the top surface of a draw bead insert, said die plate member having a complementary groove which holds said draw bead insert, said draw bead insert being supported by resilient means mounted in said die plate complementary groove, and said draw bead pressure-applying surfaces lying on a horizontal plane vertically spaced from the horizontal plane of the remaining portions of said die plate member;

(b) moving a blank holder under pressure against said metal blank to compress said metal blank holder and said pressure-applying surfaces, including the step of compressing said pressure-applying surfaces and draw bead insert against said resilient means simultaneously with the compression of said metal blank;

(c) drawing a portion of said metal blank into said die cavity; and (d) restraining the flow of metal in that portion of said metal blank compressed between said blank holder and said pressure-applying surfaces.

* * * * *